US010760473B1

(12) United States Patent
Chung et al.

(10) Patent No.: US 10,760,473 B1
(45) Date of Patent: Sep. 1, 2020

(54) METHOD FOR CHARGING COOLANT IN COOLING SYSTEM FOR VEHICLE

(71) Applicants: Hyundai Motor Company, Seoul (KR); Kia Motors Corporation, Seoul (KR)

(72) Inventors: Tae-Man Chung, Suwon-si (KR); Hyo-Jo Lee, Suwon-si (KR); Yong-Gyu Lee, Suwon-si (KR); Woo-Yeol Jung, Hwaseong-si (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 16/673,847

(22) Filed: Nov. 4, 2019

(30) Foreign Application Priority Data

Mar. 6, 2019 (KR) ..... 10-2019-0025742

(51) Int. Cl.

| | |
|---|---|
| ***F01P 11/02*** | (2006.01) |
| ***F01P 7/16*** | (2006.01) |
| *F01P 11/14* | (2006.01) |
| *F01P 11/06* | (2006.01) |

(52) U.S. Cl.
CPC ..... *F01P 11/0204* (2013.01); *F01P 7/167* (2013.01); *F01P 11/0276* (2013.01); *F01P 11/14* (2013.01); *F01P 2011/065* (2013.01); *F01P 2025/08* (2013.01); *F01P 2025/64* (2013.01); *F01P 2037/00* (2013.01)

(58) Field of Classification Search
CPC ..... F01P 11/0204; F01P 2011/065
See application file for complete search history.

(56) References Cited

U.S. PATENT DOCUMENTS 3,180,759 A * 4/1965 Falk ..... F01P 11/06 134/22.12
3,188,006 A * 6/1965 Falk ..... C23G 3/00 237/8 R
3,576,181 A * 4/1971 Neal ..... F01P 11/028 123/41.51
4,510,893 A * 4/1985 Schweiger ..... F01P 11/0247 123/41.02

(Continued)

FOREIGN PATENT DOCUMENTS

EP 2 923 052 A2 9/2015
FR 3 052 185 A1 12/2017

(Continued)

OTHER PUBLICATIONS

Extended European Search Report dated Jan. 2, 2020 for European Patent Application No. 19207978.8.

*Primary Examiner* — Kevin R Steckbauer
(74) *Attorney, Agent, or Firm* — Morgan, Lewis & Bockius LLP

(57) ABSTRACT

A method for charging coolant in a cooling system for a vehicle may include determining a vehicle-diagnostic apparatus connection that determines whether a diagnostic apparatus configured for charging coolant has been connected to a vehicle; starting a coolant charging mode for charging the coolant by the diagnostic apparatus; and determining whether a coolant charging mode release condition has been satisfied after starting the coolant charging mode.

13 Claims, 11 Drawing Sheets

(56) References Cited

U.S. PATENT DOCUMENTS

| | | | | |
|---|---|---|---|---|
| 4,790,882 | A * | 12/1988 | Barres | F01P 11/06 123/41.21 |
| 4,911,211 | A * | 3/1990 | Andersen | F01P 11/02 123/41.14 |
| 5,572,958 | A * | 11/1996 | Mader | F01P 7/167 123/41.1 |
| 6,324,757 | B1 * | 12/2001 | Barks | C09K 3/12 29/402.02 |
| 6,647,622 | B2 * | 11/2003 | Hipple | C09K 3/12 29/402.01 |
| 7,111,651 | B2 * | 9/2006 | Flynn | F01P 11/0204 141/231 |
| 8,813,792 | B2 | 8/2014 | Ehlers et al. | |
| 9,581,076 | B2 * | 2/2017 | Mushiga | F01P 11/0204 |
| 9,803,545 | B1 * | 10/2017 | Whitmer | B08B 9/00 |
| 10,012,133 | B1 * | 7/2018 | Martin | F01P 5/10 |
| 10,151,233 | B2 * | 12/2018 | Martin | F01P 3/20 |
| 2002/0073540 | A1 * | 6/2002 | Hipple | F01P 11/06 29/888.011 |
| 2006/0042721 | A1 * | 3/2006 | Flynn | F01P 11/0204 141/98 |
| 2013/0263802 | A1 * | 10/2013 | Lee | F01P 7/16 123/41.08 |
| 2015/0247443 | A1 * | 9/2015 | Mushiga | F01P 5/12 236/1 F |
| 2018/0320578 | A1 * | 11/2018 | Martin | F01N 3/10 |

FOREIGN PATENT DOCUMENTS

| | | | |
|---|---|---|---|
| KR | 10-0405537 | B1 | 11/2003 |
| WO | WO 2014/080278 | A2 | 5/2014 |

* cited by examiner

METHOD FOR CHARGING COOLANT IN COOLING SYSTEM FOR VEHICLE

CROSS-REFERENCE TO RELATED APPLICATION

The present application claims priority to Korean Patent Application No. 10-2019-0025742, filed on Mar. 6, 2019, the entire contents of which is incorporated herein for all purposes by this reference.

BACKGROUND OF THE DISCLOSURE

Field of the Disclosure

The present invention relates to a method for charging coolant in a cooling system for a vehicle, and more particularly, to a method for charging coolant in a cooling system for a vehicle by use of a diagnostic apparatus.

Description of Related Art

Generally, a water-cooled cooling system in which coolant is circulated is applied to an engine of the vehicle for a vehicle to cool the engine heated by the combustion heat of the fuel.

As illustrated in FIG. 5A and FIG. 5B, when coolant is initially injected, the coolant injected through a coolant injection port 20 reaches the front end portion of a thermostat housing 50 through the radiator 30. However, since the thermostat is opened only when the coolant temperature is equal to or greater than a certain temperature (e.g., 80° C.), the initial coolant having a low coolant temperature cannot be supplied directly to the water pump 70 through the thermostat housing 50. Therefore, the injected coolant may be supplied to the engine 10 only when it is filled up to the engine coolant outlet 60. The coolant that has been supplied to the engine 10 and has passed through a head 11, a head gasket 12, and a block 13 of the engine 10 reaches the water pump 70 and the thermostat housing 50, and some of the coolant supplied to the engine 10 reaches the thermostat housing 50 through the bypass 90. As such, some of the coolant is transferred to an exhaust gas recirculation (EGR) cooler 100 and a heater core 110 for heating the vehicle through the flow path branched from the engine coolant outlet 60.

However, this is the coolant injection path in the ideal case, and in the case of the cooling system illustrated in FIG. 6A, the EGR cooler 100 and the heater core 110 are positioned higher than the engine coolant outlet 60 side, such that as illustrated in FIG. 6B, the coolant is not sufficiently injected into the EGR cooler 100 and the heater core 110 from the engine coolant outlet 60 side thereof. In the instant case, the coolant temperature increases and sufficient coolant cannot be injected into the EGR cooler until the thermostat is opened.

Furthermore, since the air remaining in the cooling system cannot be completely taken out until the thermostat is opened due to the increase in the coolant temperature, it is impossible to inject a proper amount of coolant.

When the injection of the coolant becomes insufficient due to the above problems, there occur the problems such as engine damage due to overheating of the engine, generation of coolant flow noise at the initial of engine cold start-up, crack of the EGR cooler, the poor heating of the heater, damage of an exhaust gas treatment apparatus (SCR), etc.

Furthermore, to solve the problems, when the vehicle is left in an idle state for a long time at the time of charging the coolant, a coolant injection time becomes excessively long, and as illustrated in FIG. 7, the coolant temperature does not reach the changing temperature of the thermostat until reaching one hour after the idle operation, such that there can exist the case that the coolant is not sufficiently injected.

As such, when the engine is excessively idled at the RPM which is equal to or greater than the idle for shortening the injection time, there occurs a problem such as the engine damage during the above-described coolant injection operation.

Furthermore, as described above, since the coolant charging operation is manually performed by the operator, a deviation in the coolant injection performance occurs according to the skill of the input manpower, and since the operator may observe the injection state continuously until the injection is completed, the labor cost for charging the coolant may be excessive.

As illustrated even in FIG. 6A, the cooling system may include a water pump 70 for pushing coolant into an engine of the vehicle 10, a radiator 30 for performing a cooling operation by receiving the coolant discharged from the engine 10 and heat-exchanging with the outside air according to the opening of a thermostat, when the temperature of the coolant, which circulates the cooling system, has been heated at a certain temperature or higher by continuously operating the engine 10, a bypass 90 for connecting an engine of the vehicle coolant outlet 60 and an engine of the vehicle coolant inlet 40, and a reservoir tank connected to the radiator 30 and for storing the residual coolant.

As such, it is necessary to perform the re-injection of coolant at the time of replacing the cooling system portions of the vehicle. In the instant case, a conventional method for replenishing coolant proceeds by an operator performing the following procedure.

1) Fill the antifreeze through a radiator cap.

2) Start-up an engine of the vehicle and perform a no-load operation until the coolant is circulated.

3) When a cooling fan operates and the coolant circulation starts, replenish the coolant through the radiator cap.

4) Sufficiently discharge air from a cooling device.

5) Fill the coolant to a predetermined level of the reservoir tank by repeating the 2) to 4) until the coolant level is not reduced.

6) Wait until the coolant cools after the engine has stopped.

The information included in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing a coolant injection path when the conventional method for replenishing the coolant has been applied to an ideal cooling system illustrated in FIG. 5A is as in FIG. 5B.

The present invention is directed to solve the problems, and an object of the present invention is directed to providing a method for replenishing coolant in a cooling system for a vehicle, which has improved injection convenience and injection reliability at the time of charging coolant. The present invention is not limited to the engine coolant circulation system illustrated in FIG. 5A and FIG. 5B, but can also be applied to a coolant circulation system in which some devices are deleted or added.

A method for charging coolant in a cooling system for a vehicle according to an exemplary embodiment of the present invention for achieving the object may include determining a vehicle-diagnostic apparatus connection that determines whether a diagnostic apparatus configured for charging coolant has been connected to a vehicle; starting a coolant charging mode for charging the coolant by the diagnostic apparatus; and determining whether to satisfy a coolant charging mode release condition after starting the coolant charging mode.

According to an exemplary embodiment of the present invention, it is possible to automatically perform the coolant charging operation by the diagnostic apparatus unlike a conventional method for charging coolant that has been dependent on the manual operation of the operator.

When it is determined that it has entered the coolant charging mode, the drive of an Exhaust Gas Recirculation (EGR) device is started-off.

According to an exemplary embodiment of the present invention, it is possible to prevent the problem such as damage of an exhaust gas recirculation (EGR) cooler due to the drive of the EGR device at the time of charging the coolant.

When it is determined that it has entered the coolant charging mode, an alarm indicating that the coolant charging mode is in progress, is displayed on an instrument panel in the vehicle.

According to an exemplary embodiment of the present invention, it is possible to allow the operator to easily recognize the coolant charging progress state, improving the operation convenience.

Preferably, in the above-described coolant charging mode, the diagnostic apparatus is configured to apply a control signal to an ECU so that an engine of the vehicle is driven by alternately switching between a first operation mode for operating the engine at a predetermined first RPM for a first predetermined time period, and a second operation mode for operating the engine at a second RPM different from the first RPM for a second predetermined time.

According to an exemplary embodiment of the present invention, it is possible to operate the engine at a predetermined operation mode, increasing the coolant temperature up to the changing temperature of the thermostat. Furthermore, it is possible to alternately operate the engine at different operation modes from each other, preventing the engine from being overheated.

The method for charging the coolant in the cooling system for the vehicle may further include determining whether the coolant temperature is equal to or greater than a predetermined first temperature, and when the coolant temperature is equal to or greater than the predetermined first temperature, the coolant charging mode release condition is determined.

The vehicle may include an electric thermostat for opening and closing the cooling flow path of the cooling system, and in the coolant charging mode, the diagnostic apparatus is configured to apply a control duty value for controlling a heat-generation amount of a heater provided in the electric thermostat, adjusting the opening and closing amount of the electric thermostat.

According to an exemplary embodiment of the present invention, it is possible to control the heater provided in the electric thermostat by use of the diagnostic apparatus in the vehicle applying the electric thermostat, rapidly changing the electric thermostat.

Preferably, in the coolant charging mode, the diagnostic apparatus is configured to control so that signals of predetermined different duty magnitudes and applying times from each other are alternately repeated with respect to a PWM duty signal applied to the heater.

According to an exemplary embodiment of the present invention, it is possible to apply the duty of a high output, preventing the heater from being overheated and broken.

The method for charging the coolant in the cooling system for the vehicle may further include determining whether the coolant temperature is equal to or greater than a predetermined first temperature, and when the coolant temperature is equal to or greater than the predetermined first temperature, the control duty value may be applied to the electric thermostat.

When the coolant temperature is lower than a predetermined temperature, it is not possible to reach the changing temperature of the thermostat even when the heater of the electric thermostat is driven. Therefore, the present invention drives the heater when the coolant temperature is equal to or greater than the predetermined temperature so that the heater is not driven meaninglessly.

The vehicle may include an electric thermostat for opening and closing the cooling flow path of the cooling system, and the method for charging the coolant in the cooling system for the vehicle may further include determining whether the coolant temperature is equal to or greater than a predetermined first temperature through a primary engine drive control, and when the coolant temperature is equal to or greater than the predetermined first temperature, the diagnostic apparatus is configured to apply a control duty value for controlling a heat-generation amount of a heater provided in the electric thermostat, adjusting the opening and closing amount of the electric thermostat.

According to an exemplary embodiment of the present invention, it is possible to drive the heater of the electric thermostat after driving the engine at a predetermined drive mode so that the coolant temperature becomes the predetermined first temperature or higher, smoothly charging the coolant even when the coolant temperature is equal to or lower than the predetermined first temperature.

Preferably, in the coolant charging mode, the diagnostic apparatus is configured to apply the control duty value to the electric thermostat, and applies the control signal to the ECU so that an engine of the vehicle is driven by alternately switching between a third operation mode for operating the engine at a predetermined third RPM for a third predetermined time period, and a fourth operation mode for operating the engine at a fourth RPM different from the third RPM for a fourth predetermined time.

According to an exemplary embodiment of the present invention, it is possible to operate the engine at a predetermined operation mode while driving the heater of the electric thermostat, increasing the coolant temperature up to the changing temperature of the electric thermostat more rapidly.

The method for charging the coolant in the cooling system for the vehicle may further include determining whether a vehicle charging mode entry condition has been satisfied, when at least any one condition among the conditions in which a transmission of the vehicle is positioned at the park shifting stage (P-stage), an engine of the vehicle is being driven, and a vehicle speed is zero is satisfied.

When at least any one condition among the conditions in which the coolant temperature is equal to or greater than a second temperature, a coolant charging mode end portion thereof is selected by use of the diagnostic apparatus, the vehicle charging mode entry condition is not satisfied, and an abnormality has occurred in the electrical portions are satisfied, it is determined that a coolant charging mode release condition has been achieved.

The present invention is a diagnostic apparatus configured for charging coolant using the method for charging the coolant.

According to an exemplary embodiment of the present invention, it is possible to automatically perform the coolant charging operation by the diagnostic apparatus unlike the conventional method for charging the coolant that has been dependent on the manual operation of the operator, having no need to input additional manpower after setting the coolant injection equipment and increasing the coolant injection convenience.

Furthermore, it is possible to automatically perform the coolant charging operation by the diagnostic apparatus, ensuring the coolant injection performance to a certain degree regardless of the skill of the input manpower.

Furthermore, it is possible to shorten the time required for the coolant injection as compared with the related art, and to inject the sufficient amount of coolant into each component of the cooling system.

The present invention may be applied not only to a vehicle having a cooling system adopting an electric thermostat but also to a cooling system adopting a mechanical thermostat, and the above-described same operation and effects of the present invention may be exerted even in the cooling system adopting the mechanical thermostat.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
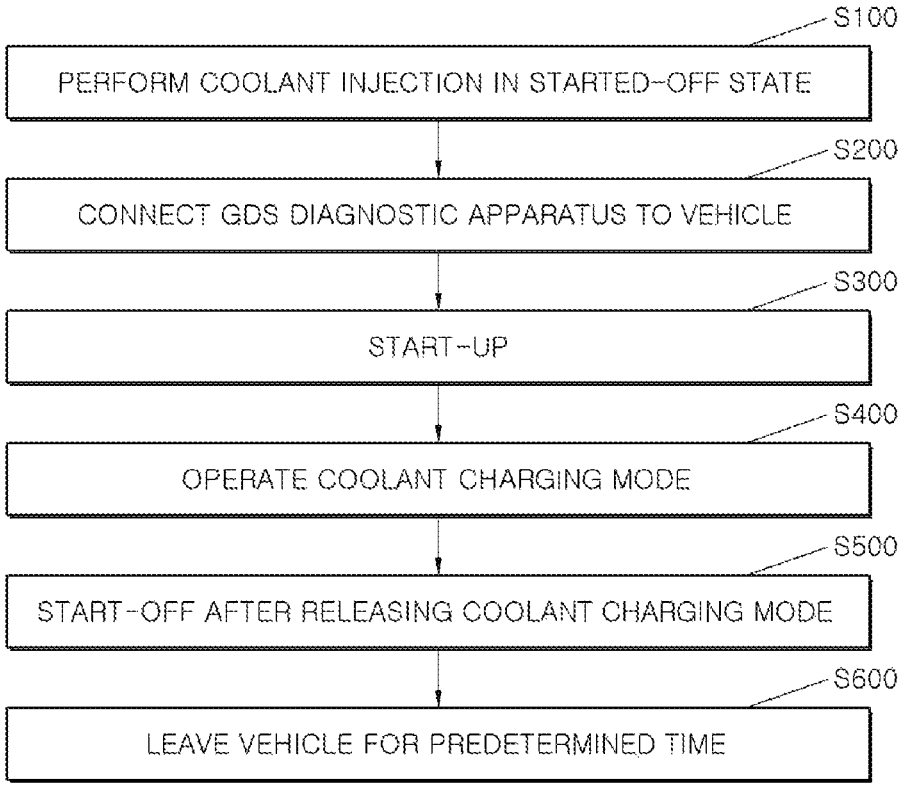
FIG. 1 is a flowchart illustrating a method for injecting coolant into a vehicle by use of a method for charging coolant in a cooling system for the vehicle according to an exemplary embodiment of the present invention.

It may be understood that the appended drawings are not necessarily to scale, presenting a somewhat simplified representation of various features illustrative of the basic principles of the present invention. The specific design features of the present invention as included herein, including, for example, specific dimensions, orientations, locations, and shapes will be determined in part by the particularly intended application and use environment.

In the figures, reference numbers refer to the same or equivalent portions of the present invention throughout the several figures of the drawing.

DETAILED DESCRIPTION

Reference will now be made in detail to various embodiments of the present invention(s), examples of which are illustrated in the accompanying drawings and described below. While the present invention(s) will be described in conjunction with exemplary embodiments of the present invention, it will be understood that the present description is not intended to limit the present invention(s) to those exemplary embodiments. On the other hand, the present invention(s) is/are intended to cover not only the exemplary embodiments of the present invention, but also various alternatives, modifications, equivalents and other embodiments, which may be included within the spirit and scope of the present invention as defined by the appended claims.

Hereinafter, the present invention will be described in detail with reference to the accompanying drawings. However, the detailed description of known functions and configurations that can unnecessarily obscure the gist of the present invention will be omitted.

FIG. 1 is a flowchart illustrating a method for actually injecting coolant into a vehicle by use of a method for charging coolant in a cooling system for a vehicle according to an exemplary embodiment of the present invention.

As illustrated in FIG. 1, when injecting coolant into a vehicle by use of a method for charging coolant in a cooling system for the vehicle according to an exemplary embodiment of the present invention, a radiator cap is first opened in a started-up state to inject a certain amount of coolant into the vehicle until the coolant does not enter through the coolant injection port 20 S100. The injection amount of coolant may be a different amount according to the vehicle and the injection state.

Next, an operator connects a diagnostic apparatus to an interface provided in the vehicle S200. The diagnostic apparatus is a diagnostic apparatus configured for the vehicle driven by a Global Diagnostic System (GDS).

In an exemplary embodiment of the presently claimed invention, the diagnostic apparatus may include a controller which may be at least one microprocessor operated by a predetermined program which may include a series of commands for carrying out a method in accordance with various exemplary embodiments of the present invention.

When the connection state of the diagnostic apparatus is confirmed, the vehicle is started-up S300, and a coolant charging mode is operated by use of the diagnostic apparatus in a state where an engine of the vehicle is in a predetermined operation state (e.g., an idle state) S400. The operation of the coolant charging mode may be started by the operator inputting a predetermined instruction to the diagnostic apparatus or pressing a specific button provided in the diagnostic apparatus.

Figure 2:
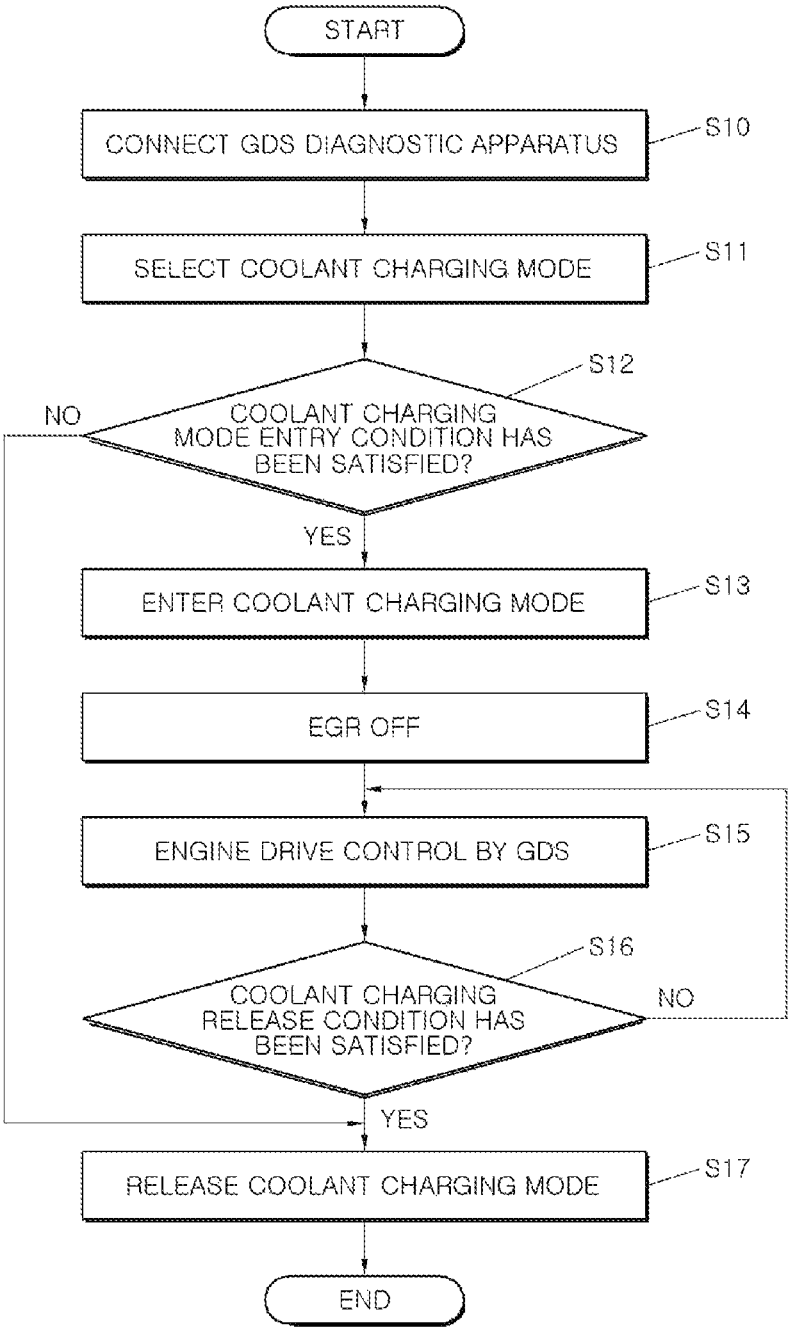
FIG. 2 is a flowchart illustrating the method for charging the coolant in the cooling system for the vehicle according to an exemplary embodiment of the present invention in the vehicle having the cooling system adopting a mechanical thermostat.
Figure 3:
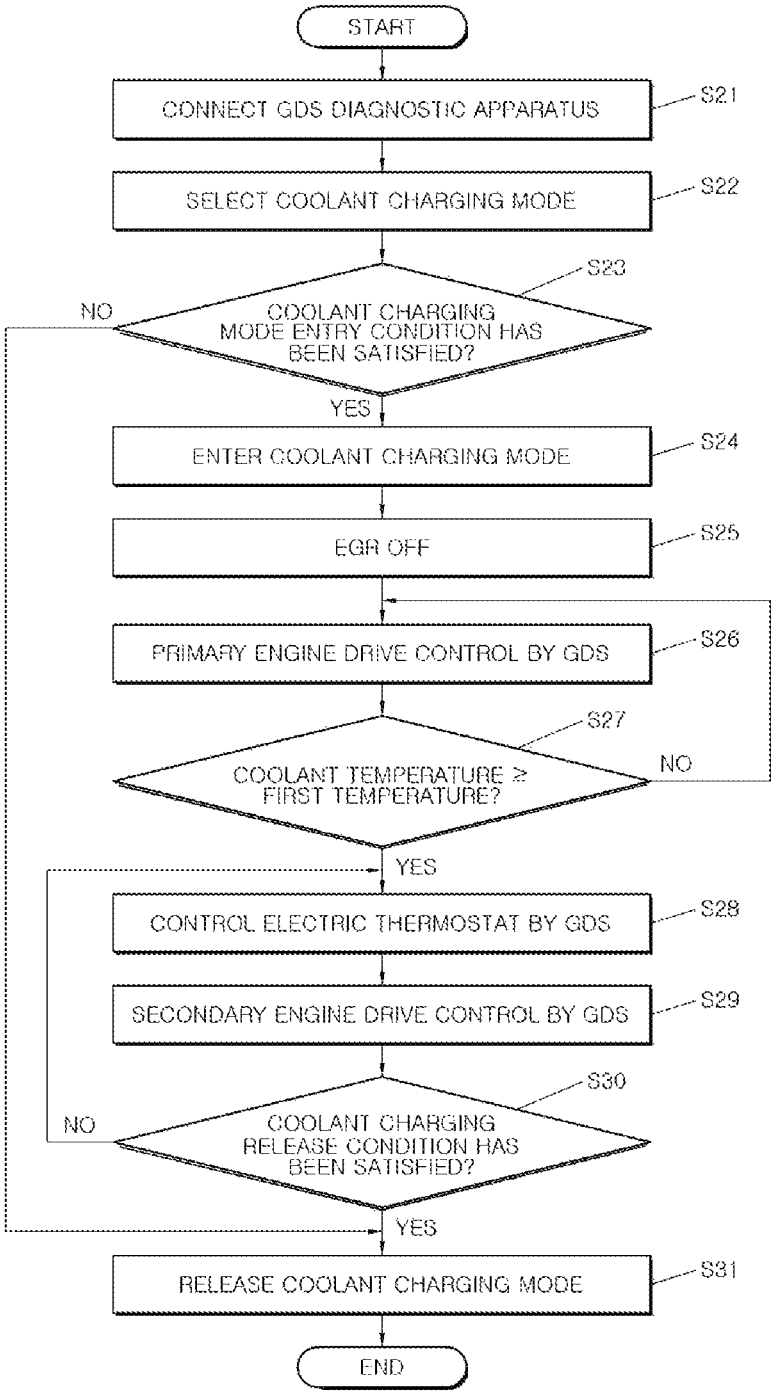
FIG. 3 is a flowchart illustrating the method for charging the coolant in the cooling system for the vehicle according to an exemplary embodiment of the present invention in the vehicle having the cooling system adopting an electric thermostat.

In the coolant charging mode, which will be described later, the coolant charging control, which will be described later with reference to FIG. 2 and FIG. 3, is performed. As such, when a predetermined coolant charging mode release condition is satisfied after the coolant charging mode is started, the coolant charging mode is released and the engine is started-off S500.

The vehicle is left for a predetermined time so that the coolant reduces to a proper water temperature after the engine has been started-off S600.

FIG. 2 is a flowchart illustrating the method for charging the coolant in the cooling system for the vehicle according to an exemplary embodiment of the present invention in the vehicle having the cooling system adopting a mechanical thermostat. In FIG. 2, the method for charging the coolant according to an exemplary embodiment of the present invention will be described in more detail focusing on a coolant charging mode S400 illustrated in FIG. 1.

As illustrated in FIG. 2, the diagnostic apparatus is connected to a predetermined interface of the vehicle that has been started-off S10.

The operator selects the coolant charging mode by operating a predetermined switch provided in the diagnostic apparatus, or inputting a predetermined instruction into a GDS program through an input device such as a keyboard S11.

When the coolant charging mode is selected in the S11, the diagnostic apparatus determines whether a predetermined coolant charging mode entry condition is satisfied S12. The coolant charging mode entry condition means a basic condition required to be satisfied to stably perform the coolant injection operation. Even when the coolant charging mode is selected by the operator, the coolant charging mode cannot proceed when the predetermined coolant charging mode entry condition is not satisfied.

When at least any one condition among the conditions in which a transmission of the vehicle is positioned at the park shifting stage (P-stage) and a vehicle speed is zero when the engine of the vehicle is driven is satisfied, it is determined that the vehicle charging mode entry condition has been satisfied.

When it is determined in the S12 that the coolant charging mode entry condition has been satisfied, the diagnostic apparatus enters the coolant charging mode S13.

Meanwhile, it is difficult to supply the appropriate amount of coolant to the EGR cooler 100 during the coolant injection operation. Therefore, to prevent the EGR cooler from being broken, etc. At the cooler injection operation, the diagnostic apparatus preferably transmits a control signal to a controller such as engine control unit (ECU) so that the EGR function is turned off S14.

When the coolant charging mode is started, the diagnosis unit takes out the air in the cooling system, and performs a control of increasing the coolant temperature up to the changing temperature of a thermostat so that the proper amount of coolant may be supplied to the entire cooling system. The diagnostic apparatus is configured to control the ECU so that the engine 10 may be operated at a predetermined RPM. However, when the engine 10 is driven at a high RPM for a long time, the engine damage due to overheating of the engine 10 can occur, such that after rotating the engine 10 at a high speed for a first predetermined time period, it is preferable to rotate the engine 10 at a low speed for a second predetermined time. For example, a control signal is applied to the ECU so that the engine is driven by alternately switching between an operation mode for driving the engine at the idle RPM for 60 seconds and an operation mode for driving the engine at the RPM of 2000 rpm for 60 seconds. The exemplary RPM and operation time of the engine can vary according to the vehicle model.

Next, the diagnostic apparatus determines whether the coolant charging mode release condition has been satisfied to determine whether the coolant has been sufficiently supplied by performing the coolant charging mode in the S15 or whether the coolant charging mode may be stopped by the external condition S16.

Preferably, it is determined that the coolant charging mode release condition has been achieved when at least any one condition among the conditions in which the coolant temperature is equal to or greater than a predetermined second temperature, a coolant charging mode end portion thereof is selected by use of the diagnostic apparatus, the vehicle charging mode entry condition in the S12 is not satisfied, and an abnormality has occurred in the electrical parts.

Herein, the second temperature means a temperature capable of changing the mechanical thermostat for opening and closing the flow path of the cooling system. The second temperature is preferably 85° C., but the corresponding temperature range can vary according to the characteristics of the thermostat provided in the vehicle. When it is determined that the coolant temperature is equal to or greater than the second temperature, the thermostat is changed, and therefore, the conditions for taking out the air in the cooling system and supplying the proper amount of coolant are satisfied, releasing the coolant charging mode S17.

Furthermore, even when the coolant temperature does not satisfy the above conditions, the coolant charging mode is released when the operator inputs the coolant charging mode end instruction S17. Furthermore, when the coolant charging mode entry condition determined in the S12 is not satisfied, or when it is determined that an abnormality has occurred in the in-vehicle electrical portions such as a coolant temperature sensor, it is difficult to stably supply the coolant, such that even in the instant case, the coolant charging mode is released S17. As such, when the coolant is sufficiently supplied and the coolant charging mode is released, the EGR function stopped in the S14 may be resumed.

FIG. 3 is a flowchart illustrating the method for charging the coolant in the cooling system for the vehicle according to an exemplary embodiment of the present invention in the vehicle having a cooling system adopting an electric thermostat. In the case of the electric thermostat, a heater is provided therein, such that the change in the thermostat is possible by driving the heater even when the coolant temperature does not reach a predetermined temperature. Hereinafter, an exemplary embodiment of the present invention will be described in more detail with reference to FIG. 3 focusing on the coolant charging mode S400 in the vehicle having the cooling system adopting the electric thermostat.

S21 to S25 illustrated in the flowchart of FIG. 3 are substantially the same as the S10 to S14 illustrated in FIG. 2. Therefore, duplicate description of the contents described with reference to FIG. 2 will be omitted.

Unlike the example illustrated in FIG. 2, when coolant is injected into the vehicle having the cooling system adopting the electric thermostat, in the coolant charging mode S400, a PWM control for driving the heater provided in the electric thermostat may be performed instead of a control of driving the engine at a predetermined RPM S28. In the instant case, the diagnostic apparatus transfers a control signal for driving the heater provided in the electric thermostat to the ECU, and the ECU controls the heater of the electric thermostat according to the instruction of the diagnostic apparatus. Meanwhile, when a 100% control duty value is applied to the heater of the electric thermostat for a long time, the heater may be overheated and damaged, such that it is preferable to control the heater so that signals of predetermined different duty magnitudes and duty applying times from each other are alternately repeated. For example, when controlling the heater, the diagnostic apparatus instructs a control so that a control of applying a control duty value of output 100% for 40 seconds and a control of applying a control duty value of output 40% for 20 seconds are alternately performed. Through the above-described control, when the wax inside the electric thermostat is heated to the proper level by the heater, the electric thermostat is changed as in the result of the drive control of the engine in the S15 in FIG. 2.

Meanwhile, when the coolant temperature is lower than a certain temperature, the wax cannot be expanded to a target value even when the heater of the electric thermostat is driven, such that the electric thermostat cannot be changed. Therefore, the diagnostic apparatus determines whether the coolant temperature is equal to or greater than a predetermined first temperature (e.g., 75° C.) S27, and performs a control of the electric thermostat in S28 only when the coolant temperature is equal to or greater than the predetermined first temperature.

However, in the instant case, there is a problem that the coolant charging becomes impossible when the coolant temperature is lower than the predetermined first temperature. Therefore, in an exemplary embodiment of the present invention, prior to the control of the electric thermostat in the S28, a primary engine drive control for operating the engine in a predetermined operation mode S26 is performed so that the coolant temperature is equal to or greater than the predetermined first temperature.

In the primary engine drive control S26, as in the S15 in FIG. 2, the diagnostic apparatus instructs the ECU to alternately perform different engine drive modes. For example, the engine may be driven by alternately switching between an operation mode for driving the engine at the idle RPM for 60 seconds and an operation mode for driving the engine at the RPM of 2000 rpm for 60 seconds. As a result of the above control, when the coolant temperature becomes equal to or greater than the predetermined first temperature, the control of the electric thermostat in the S28 is performed as described above.

As such, as in the S16 of an exemplary embodiment in FIG. 2, after the start of the coolant charging mode, it is determined whether the predetermined coolant charging mode release condition has been satisfied S30, and when the corresponding condition has been satisfied, the coolant charging mode is released. When it reaches the second temperature (e.g., 80° C.) configured for changing the electric thermostat, the electric thermostat is changed, and therefore, the conditions for taking out the coolant in the cooling system and supplying the proper amount of coolant are satisfied, releasing the coolant charging mode S31.

Furthermore, even when the coolant temperature does not satisfy the above conditions, the coolant charging mode is released when the coolant charging mode end portion instruction is inputted by the operator S31. Furthermore, when the coolant charging mode entry condition determined in the S23 is not satisfied, or it is determined that an abnormality has occurred in the in-vehicle electric components such as the coolant temperature sensor and the heater of the electric thermostat, it is difficult to stably supply the coolant, such that even in the instant case, the coolant charging mode is released S31. As such, when the coolant is sufficiently supplied and the coolant charging mode is released, the EGR function stopped in the S25 may be resumed.

As described above, in the vehicle having the cooling system adopting the electric thermostat, a control is performed to drive the heater of the electric thermostat in the coolant charging mode. However, a control for driving the heater of the electric thermostat and operating the engine in a predetermined operation mode (hereinafter referred to as 'secondary engine drive control') can also be performed in parallel to increase the coolant temperature up to the changing temperature of the electric thermostat more rapidly.

For the present purpose, in S29, the diagnostic apparatus instructs the ECU to alternately perform between the different engine drive modes. For example, the engine can also be driven by alternately switching between an operation mode for driving the engine at the idle RPM for 60 seconds and an operation mode for driving the engine at the RPM of 2000 rpm for 40 seconds. The operation conditions of the engine in the primary engine drive control and the secondary engine drive control may be the same, or can also be performed in different conditions from each other. As a result of the heater control and the secondary engine drive control of the electric thermostat, when the coolant temperature reaches a predetermined temperature configured for changing the electric thermostat, the coolant charging mode is released S31 as described above.

Embodiment

Hereinafter, the operation and effect of according to an exemplary embodiment of the present invention will be described with reference to FIG. 4A, FIG. 4B and FIG. 4C by comparing the cooling charging times of according to an exemplary embodiment of the present invention and a comparative example.

For the present purpose, firstly, the coolant of the radiator and the thermostat of the vehicle having the cooling system adopting the electric thermostat were all discharged, and the discharged coolant at the present time was measured (3800 ml in the present example). As such, the radiator cap of the vehicle was opened in the started-off state and the discharged coolant was primarily injected therein again, and the amount of coolant remaining after injection was measured (480 ml in the present example). Thereafter, the coolant was charged by varying the charging conditions in the coolant charging mode, and the time until the amount of coolant remaining after the primary injection was all charged was measured.

Figure 4A:
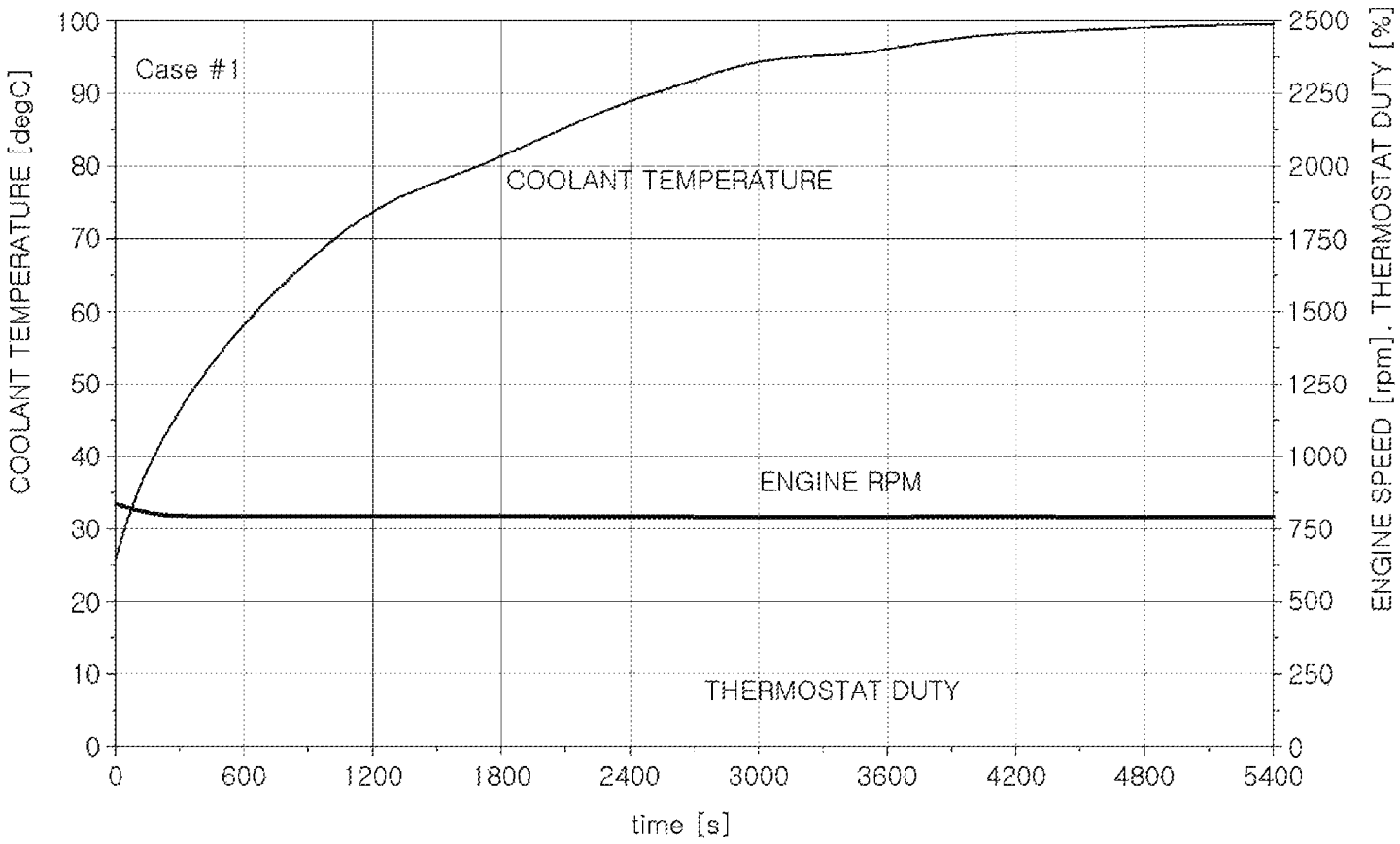
FIG. 4A is a graph illustrating a change in the coolant temperature with a time when injecting the coolant according to a comparative example.
Figure 4B:
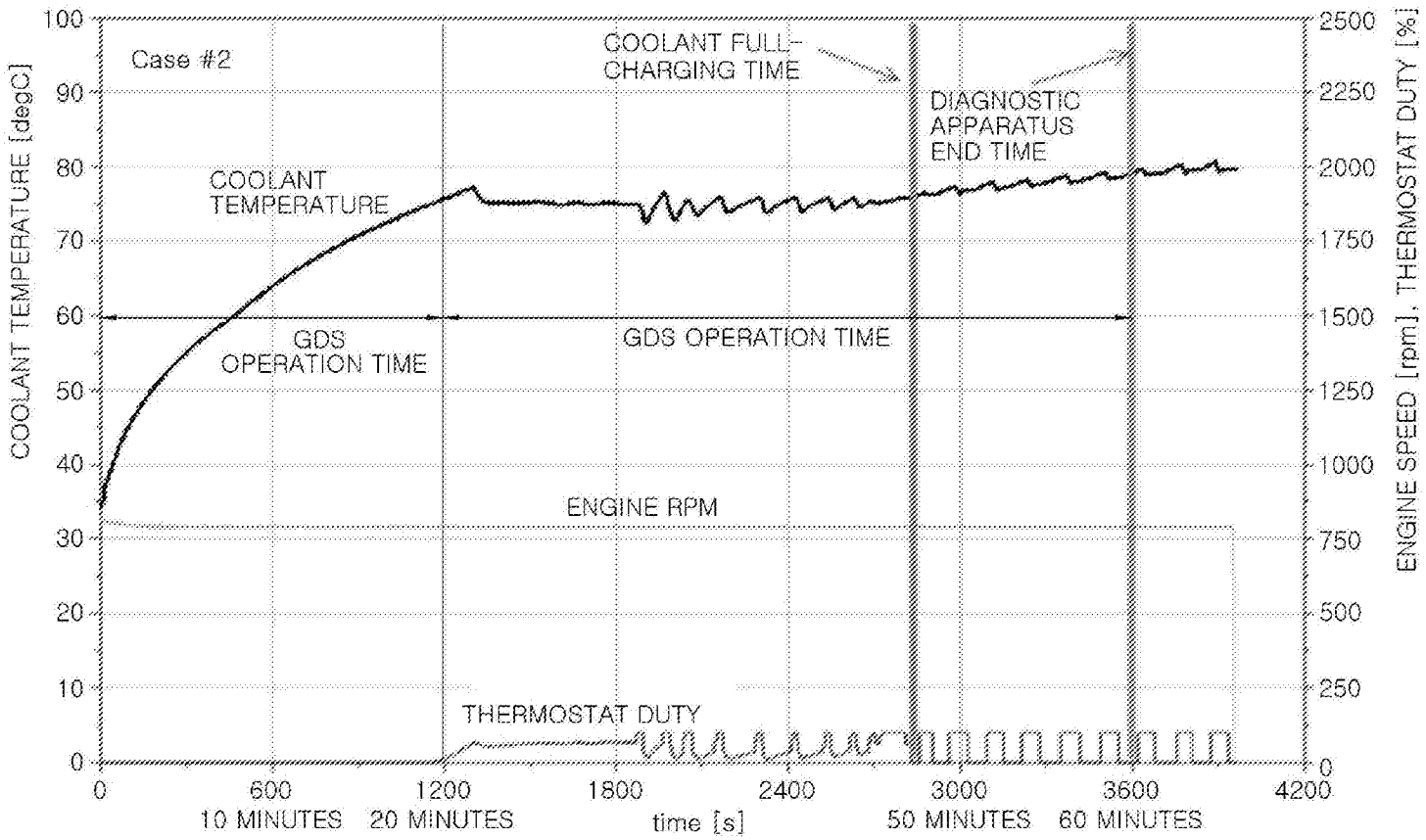
FIG. 4B is a graph illustrating a change in the coolant temperature with a time when injecting the coolant according to an exemplary embodiment of the present invention.
Figure 4C:
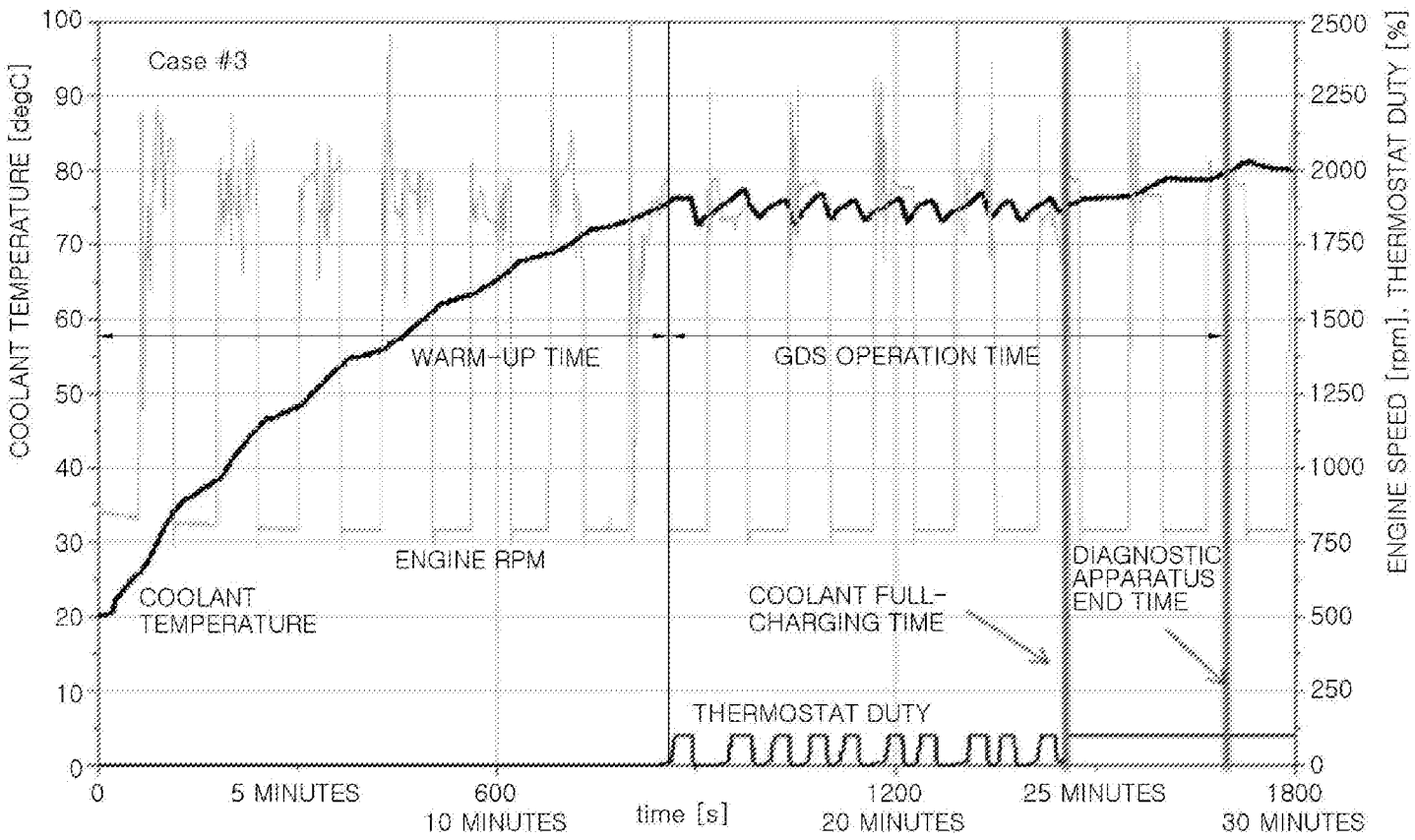
FIG. 4C is a graph illustrating a change in the coolant temperature with a time when injecting the coolant according to various exemplary embodiments of the present invention.
Figure 5A:
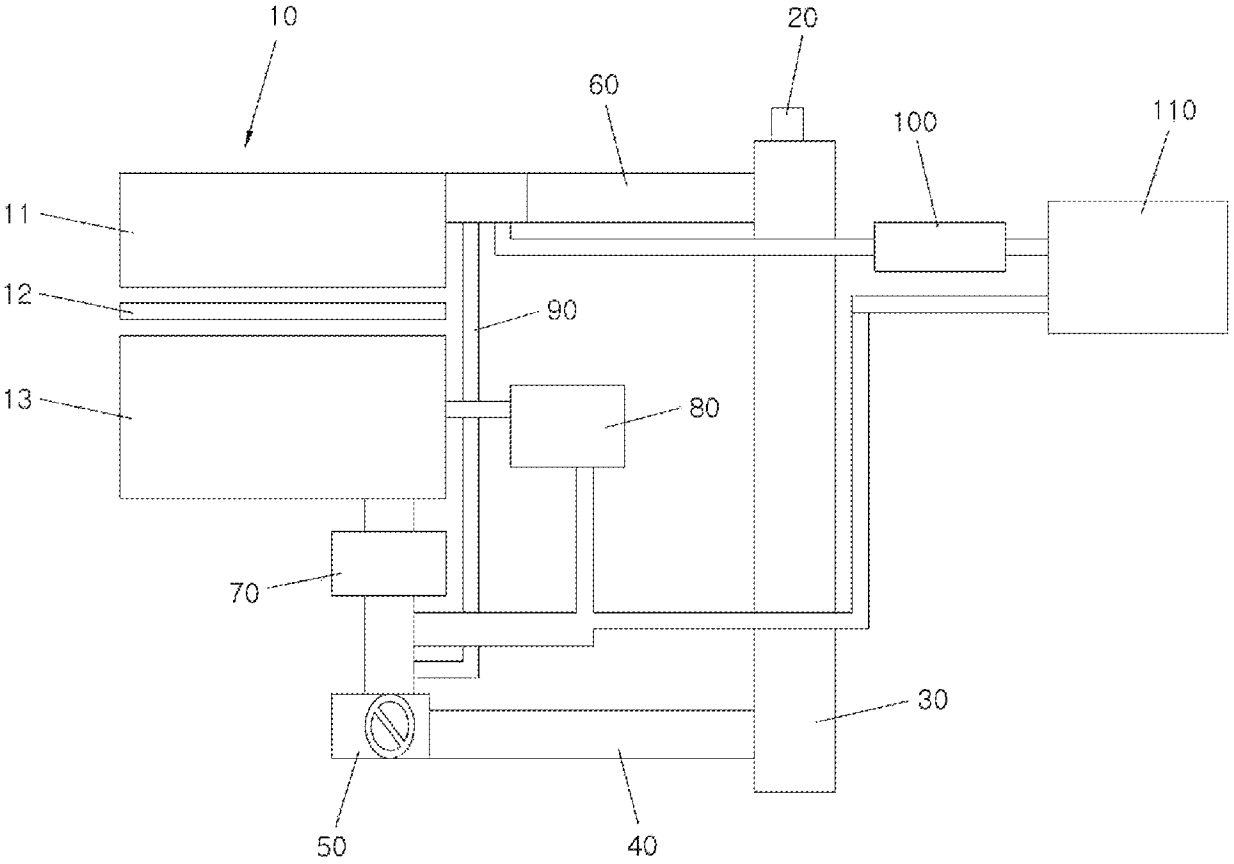
FIG. 5A is a diagram schematically illustrating a structure of an ideal cooling system.
Figure 5B:
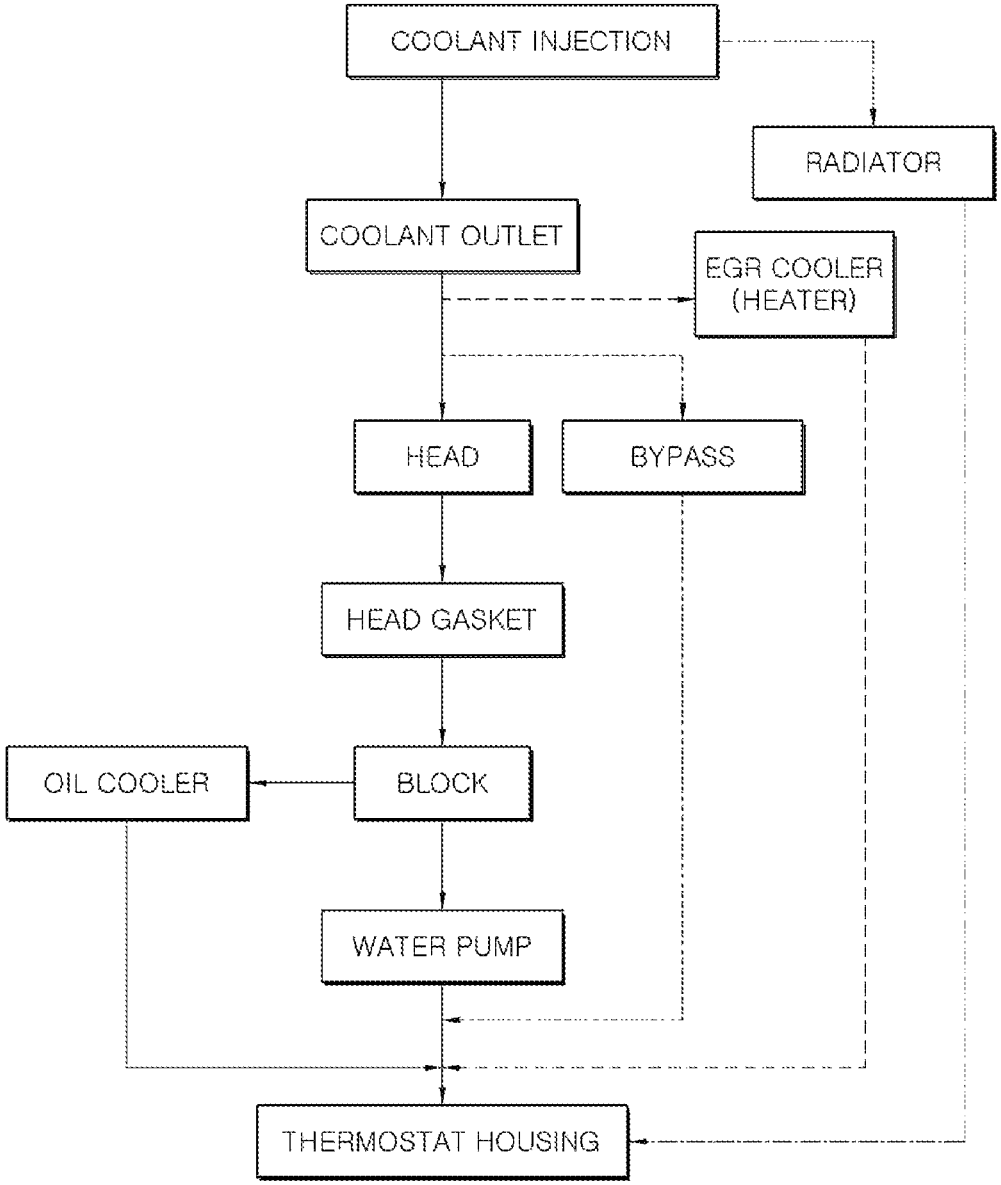
FIG. 5B is a diagram sequentially illustrating the flow of the injected coolant in FIG. 5A.
Figure 6A:
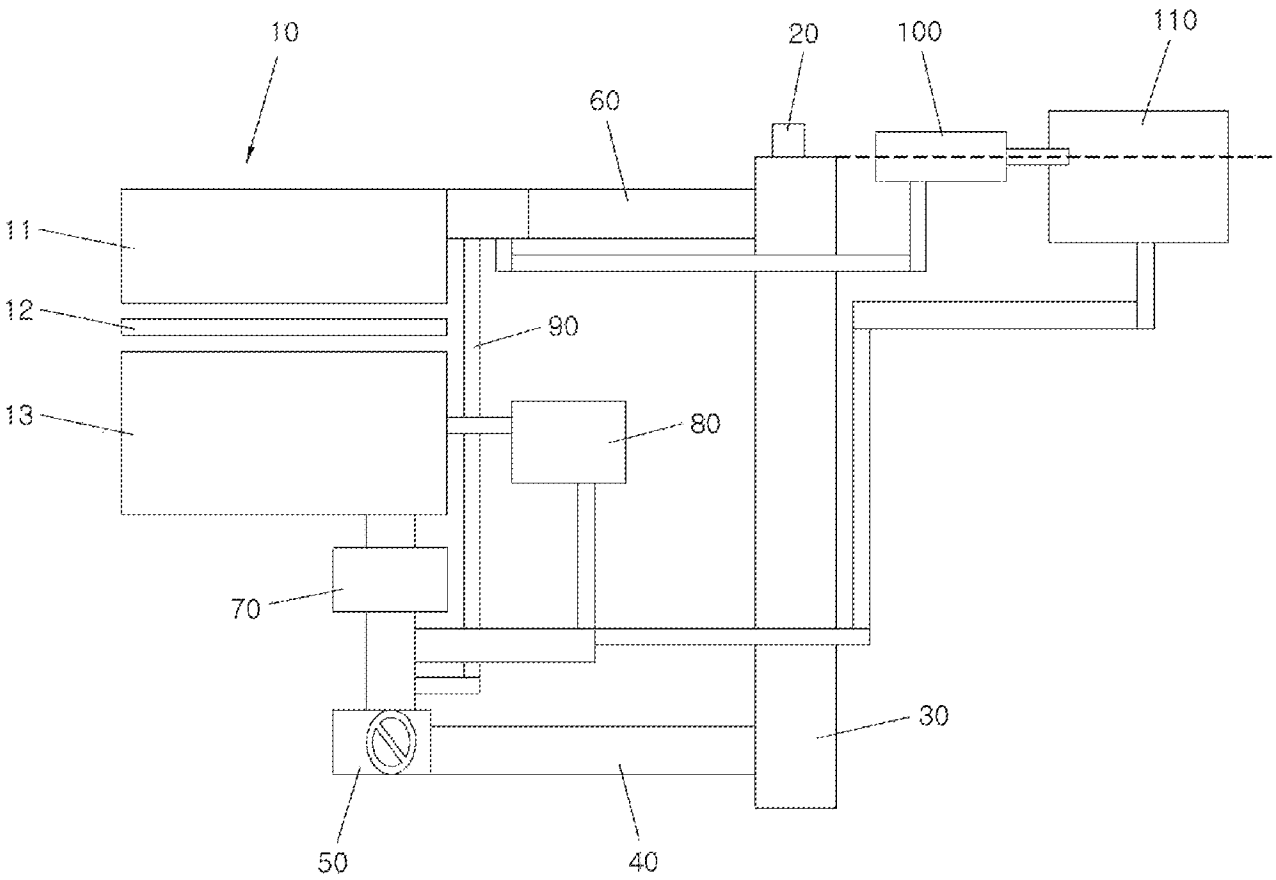
FIG. 6A is a diagram schematically illustrating a structure of an actual cooling system.
Figure 6B:
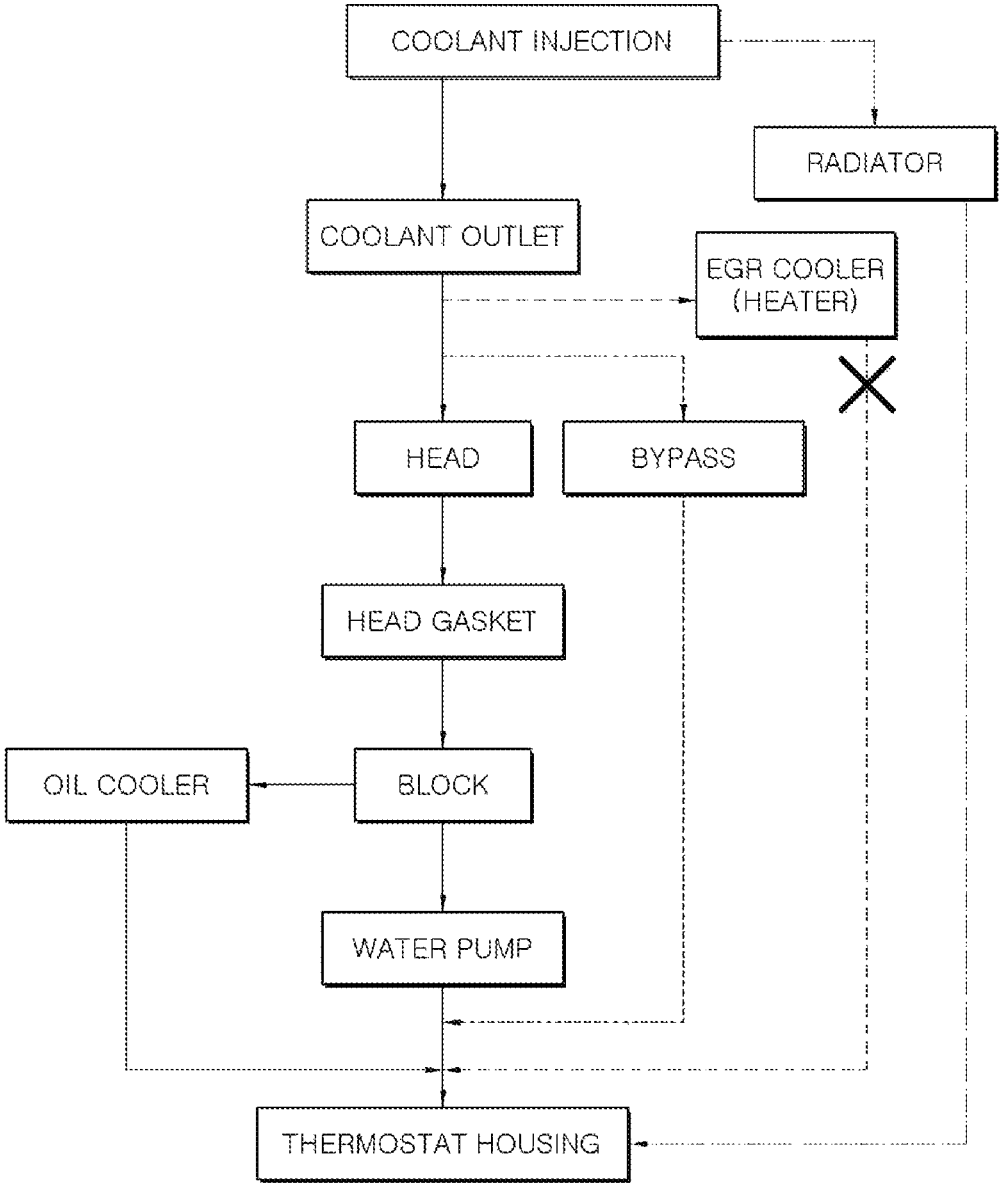
FIG. 6B is a diagram sequentially illustrating the flow of the injected coolant in FIG. 6A.
Figure 7:
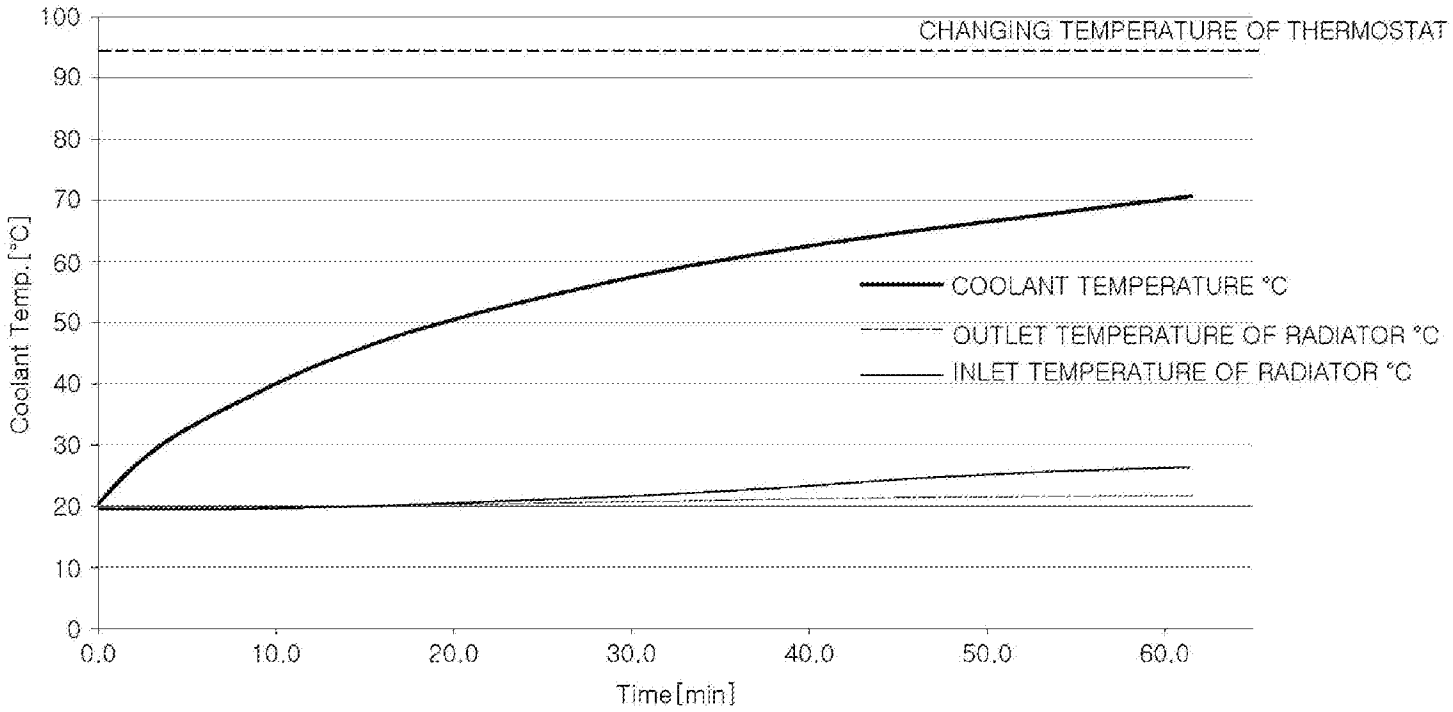
FIG. 7 is a graph illustrating a change in the coolant temperature with a time when injecting the coolant according to a conventional method.

At the time of charging the coolant, in the case of Case #1 which is a comparative example, as illustrated in FIG. 4A, the power was not applied to the electric thermostat, and the engine was continuously operated in the idle condition. As such, in the case of Case #2 which is an exemplary embodiment of the present invention, as illustrated in FIG. 4B, the diagnostic apparatus controlled so that the engine was driven in the idle state, and when the coolant temperature reached 75° C. in that state, the diagnostic apparatus controlled so that the heater of the electric thermostat was driven, and when the coolant temperature reached 85° C., the coolant charging mode was released. As such, in the case of Case #3 which is another exemplary embodiment of the present invention, as illustrated in FIG. 4C, while controlling so that the engine was alternately operated in the idle RPM condition and the RPM of 2000 rpm condition, the diagnostic apparatus controlled so that the heater of the electric thermostat was driven when the coolant temperature reached 75° C., and when the coolant temperature reached 85° C., the coolant charging mode was released. The charging required time for each coolant charging condition was as in Table 1 as follows.

TABLE 1

| | Coolant temperature (° C.) | | Charging consumption time | | | | |
|---|---|---|---|---|---|---|---|
| Items | Heater On | Heater Off | Primary charging (1) | Before operating a heater (2) | After operating a heater (3) | Total required time (minute) (1) + (2) + (3) | Remark |
| Case #1 | — | — | 20 minutes | 90 minutes | — | 110 minutes | Comparative example |
| Case #2 | 75° C. | 80° C. | 20 minutes | 21 minutes | 38.5 minutes | 79.5 minutes | Present invention example |
| Case #3 | 75° C. | 80° C. | 20 minutes | 14 minutes | 14.1 minutes | 48.1 minutes | Present example invention |

As illustrated in Table 1, in the Case #1 where the coolant was charged in the condition so that the engine was in the idle state, it took 90 minutes to reach the coolant temperature (80° C.) at which the electric thermostat was changed, such that the total required time for charging the coolant was 110 minutes, which was relatively long.

Meanwhile, in the Case #2, when the coolant temperature was increased up to 75° C. in the state where the engine rotated at the idle RPM, the heater of the electric thermostat was operated, shortening the time to reach the coolant temperature (80° C.) at which the electric thermostat was changed. As a result, the total required time for charging the coolant was 79.5 minutes, which was relatively shortened.

As such, in the Case #3, the RPM of the engine was alternately switched between the idle and 2000 rpm, such that the time required for the coolant temperature to increase to 75° C. was shortened by 7 minutes as compared with the Case #2, and furthermore, the time to reach the coolant temperature (80° C.) at which the electric thermostat was changed was further shortened as compared with the Case #2. As a result, the total required time for charging the coolant was 48.1 minutes, which could be shortened as compared with the Case #1 and the Case #2.

For convenience in explanation and accurate definition in the appended claims, the terms "upper", "lower", "inner", "outer", "up", "down", "upwards", "downwards", "front", "rear", "back", "inside", "outside", "inwardly", "outwardly", "internal", "external", "inner", "outer", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. A method of charging coolant in a cooling system for a vehicle, the method comprising:

determining that a diagnostic apparatus configured for charging the coolant is connected to the vehicle's engine control unit (ECU), the determination being made by the diagnostic apparatus;

in response to the determination that the diagnostic apparatus is connected to the vehicle's ECU, starting a coolant charging mode for charging the coolant by the diagnostic apparatus, wherein starting the coolant charging mode includes starting an engine of the vehicle by the diagnostic apparatus; and determining, by the diagnostic apparatus, when a coolant charging mode release condition has been satisfied after starting the coolant charging mode.

2. The method of charging the coolant in the cooling system for the vehicle of claim 1, wherein in response to determining that the coolant charging mode is entered, a drive of an Exhaust Gas Recirculation (EGR) device is turned-off.

3. The method of charging the coolant in the cooling system for the vehicle of claim 1, wherein in response to determining that the coolant charging mode is entered, an alarm indicating that the coolant charging mode is in progress is displayed on an instrument panel in the vehicle.

4. The method of charging the coolant in the cooling system for the vehicle of claim 1, wherein in the coolant charging mode, the diagnostic apparatus is configured to apply a control signal to the ECU so that the engine of the vehicle is driven by alternately switching between a first operation mode for operating the engine at a predetermined first revolutions per minute (RPM) for a first predetermined time period, and a second operation mode for operating the engine at a second RPM different from the first RPM for a second predetermined time.

5. The method of charging the coolant in the cooling system for the vehicle of claim 1, further including:

determining when a coolant temperature is equal to or greater than a predetermined first temperature, wherein in response to the coolant temperature being equal to or greater than the predetermined first temperature, the coolant charging mode release condition is determined.

6. The method of charging the coolant in the cooling system for the vehicle of claim 1, wherein the vehicle includes an electric thermostat for opening and closing a cooling flow path of the cooling system, and wherein in the coolant charging mode, the diagnostic apparatus is configured to apply a control duty value for controlling a heat-generation amount of a heater provided in the electric thermostat, and adjust an opening and closing amount of the electric thermostat.

7. The method of charging the coolant in the cooling system for the vehicle of claim 6, wherein in the coolant charging mode, the diagnostic apparatus is configured to control so that signals of predetermined different duty magnitudes and applying times from each other are alternately repeated with respect to a pulse width modulation (PWM) duty signal applied to the heater.

8. The method of charging the coolant in the cooling system for the vehicle of claim 6, further including determining when a coolant temperature is equal to or greater than a predetermined first temperature, wherein in response to the coolant temperature being equal to or greater than the predetermined first temperature, the control duty value is applied to the electric thermostat.

9. The method of charging the coolant in the cooling system for the vehicle of claim 4, further including:

determining when a coolant temperature is equal to or greater than a predetermined first temperature, and wherein in response to the coolant temperature being equal to or greater than the predetermined first temperature, the diagnostic apparatus is configured to apply a control duty value for controlling a heat-generation amount of a heater provided in an electric thermostat for opening and closing a cooling flow path of the cooling system, adjusting an opening and closing amount of the electric thermostat.

10. The method of charging the coolant in the cooling system for the vehicle of claim 9, wherein in the coolant charging mode, the diagnostic apparatus is configured to apply the control duty value to the electric thermostat, and to apply the control signal to the ECU so that the engine is driven by alternately switching between a third operation mode for operating the engine at a predetermined third RPM for a third predetermined time period, and a fourth operation mode for operating the engine at a fourth RPM different from the third RPM for a fourth predetermined time.

11. The method of charging the coolant in the cooling system for the vehicle of claim 1, further including:

determining when a vehicle charging mode entry condition has satisfied, wherein when at least one condition among a plurality of conditions in which a transmission of the vehicle is positioned at a park shifting stage (P-stage), the engine of the vehicle is being driven, and a vehicle speed is zero is satisfied, the vehicle charging mode entry condition is determined to have been satisfied.

12. The method of charging the coolant in the cooling system for the vehicle of claim 1, wherein in response to at least one condition among a plurality of conditions in which a coolant temperature is equal to or greater than a second temperature, a coolant charging mode end portion thereof is selected by use of the diagnostic apparatus, a vehicle charging mode entry condition is not satisfied, and an abnormality has occurred in electrical portions is satisfied, a coolant charging mode release condition is determined to have been achieved.

13. A diagnostic apparatus for charging coolant in a cooling system for a vehicle, comprising a controller configured to:

determine that the diagnostic apparatus is connected to the vehicle's engine control unit (ECU);

in response to the determination that the diagnostic apparatus is connected to the vehicle's ECU, start a coolant charging mode for charging the coolant by the diagnostic apparatus, wherein starting the coolant charging mode includes starting an engine of the vehicle by the diagnostic apparatus; and determine, by the diagnostic apparatus, when a coolant charging mode release condition has been satisfied after starting the coolant charging mode.

* * * * *